US008138677B2

(12) United States Patent
Morehouse

(10) Patent No.: US 8,138,677 B2
(45) Date of Patent: Mar. 20, 2012

(54) RADIAL HALL EFFECT ION INJECTOR WITH A SPLIT SOLENOID FIELD

(76) Inventor: Mark Edward Morehouse, Costa Mesa, CA (US)

( * ) Notice: Subject to any disclaimer, the term of this patent is extended or adjusted under 35 U.S.C. 154(b) by 919 days.

(21) Appl. No.: 12/150,766

(22) Filed: May 1, 2008

(65) Prior Publication Data

US 2009/0273284 A1 Nov. 5, 2009

(51) Int. Cl.
*H05B 31/26* (2006.01)

(52) U.S. Cl. ..... 315/111.41; 315/111.61; 315/501

(58) Field of Classification Search ..... 315/111.21–111.91, 500–507; 219/121.43, 121.44, 651
See application file for complete search history.

(56) References Cited

U.S. PATENT DOCUMENTS 3,120,475 A 2/1964 Bennett
3,309,873 A 3/1967 Cann
3,388,291 A 6/1968 Cann
4,267,488 A * 5/1981 Wells ..... 376/107
4,293,794 A 10/1981 Kapetanakos
4,788,024 A 11/1988 Maglich
5,444,207 A * 8/1995 Sekine et al. ..... 219/121.43
5,973,447 A 10/1999 Mahoney
6,086,962 A 7/2000 Mahoney
6,448,721 B2 9/2002 Raitses
6,523,338 B1 2/2003 Kornfeld
6,545,419 B2 * 4/2003 Vella ..... 315/111.21
6,593,539 B1 * 7/2003 Miley et al. ..... 219/121.36
6,713,976 B1 * 3/2004 Zumoto et al. ..... 315/500
6,777,862 B2 8/2004 Fisch
7,075,095 B2 7/2006 Kornfeld
7,514,875 B2 * 4/2009 Shun'ko ..... 315/111.21
7,825,601 B2 * 11/2010 Morehouse ..... 315/111.81
2004/0026412 A1 * 2/2004 Brande et al. ..... 219/601
2006/0267503 A1 * 11/2006 Bystriskii et al. ..... 315/111.21
2009/0140672 A1 * 6/2009 Gall et al. ..... 315/502

* cited by examiner

*Primary Examiner* — Tung X Le

(57) ABSTRACT

A closed drift Hall Current accelerator with a split solenoid Hall field, a radial injection collimated gas source, an anode, intermediate Hall effect ionization magnetic field structures and intermediate acceleration electrodes, for injection of ions into the solenoid field. The Hall Effect field in this case is in the gap of the return field of the split solenoid magnetic field.

21 Claims, 4 Drawing Sheets

RADIAL HALL EFFECT ION INJECTOR WITH A SPLIT SOLENOID FIELD

CROSS-REFERENCE TO RELATED APPLICATIONS

This application relates to my prior patent application Ser. No. 11/998,083 filed Nov. 28, 2007, USPTO Confirmation No. 5189, which is incorporated by reference.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

INCORPORATION-BY-REFERENCE OF MATERIAL SUBMITTED ON A COMPACT DISC

Not applicable.

REFERENCE TO A "MICROFICHIE APPENDIX"

Not applicable.

BACKGROUND OF THE INVENTION

1. Field of the Invention

This disclosure relates generally to a closed drift Hall type ion accelerator in a vacuum space, and more particularly to a closed drift Hall Current accelerator operating radially across an axial magnetic field gap between a pair of split solenoid windings.

2. Background of the Invention

Hall accelerators generally operate by accelerating ions along the axis of some form of a solenoid type magnetic field. Most commonly, as in single stage Hall thrusters, the gas is sourced from within the solenoid structure, and the ions are accelerated axially through an open fringe field. In the less common two stage Hall accelerator, the gas is sourced from generally outside the solenoid field but the acceleration is still axial, across the radial aspect of the solenoid fringe field. In such devices the axial field component is minimized as well as its influence on the ion trajectories. Hall Effect accelerators are designed to capture electrons in Hall Effect drift orbits and therefore need to have acceleration channels with a width greater than the electron orbit gyro-radius. The ion trajectories are also bent in the Hall Effect magnetic field, however they are only allowed to bend a very small amount so that their trajectories remain essentially axial. Hall Effect accelerators have not been used to accelerate ions into a solenoid field. The prior art involves accelerating ions axially, out of or through the magnetic field.

In an attempt to transport ions into a solenoid, ions have been injected axially as well as radially. Axial injection involves cross field transport across the fringe field. Radial injection involves transport across the solenoid return field. Plasma beam transport across magnetic field flux proceeds by one of three effects. At low densities, ions transport across the magnetic field according to classical single particle dynamics. At medium densities, plasma beams become electrically polarized by the magnetic field. The polarization electric field tends to keep the beams together, counteracting the tendency of the beam to bend under the influence of the magnetic field, thereby allowing the beam to propagate relatively un-deviated across the field. At high densities, the beam plasma excludes the magnetic field from the interior of the beam and the beam passes without deviation across the field. These effects are the result of the fact that the ions and electrons are separated upon encountering a magnetic field. Hall Effect accelerators operate without ion electron separation.

The following references illustrate some of the prior art with regard to Hall Current accelerators and cross field charged particle transport. Raitses et. al. in U.S. Pat. No. 6,448,721 reveals an example of the progression of Hall accelerators from the common annular design towards a reduction of the inner electrode with their cylindrical geometry Hall accelerator. The design references a single stage Hall accelerator. Fisch et. al in U.S. Pat. No. 6,777,862 discloses a segmented electrode Hall thruster with reduced plume which addresses the importance of reducing plume divergence. Mahoney et. al. in U.S. Pat. Nos. 5,973,447 and 6,086,962 discloses a gridless Hall effect ion source for the vacuum processing of materials. Kornfeld et. al. in U.S. Pat. Nos. 6,523,338 and 7,075,095 discloses plasma accelerators using multi-acceleration stages. Cann in U.S. Pat. No. 3,309,873 discloses a plasma accelerator utilizing a Laval type nozzle, and Cann in U.S. Pat. No. 3,388,291 discloses an annular array of multiple collimating anode gas sources. W. H. Bennett in U.S. Pat. No. 3,120,475 claims a means of injecting ions radially into a magnetic field, at a position that is off the center and off the axis of the magnetic field chamber. Maglich in U.S. Pat. No. 4,788,024 discloses radial injection of a beam of charged particles into a magnetic field inside a vacuum zone, thereby producing ions that generally have zero canonical angular momentum. Kapetanakos in U.S. Pat. No. 4,293,794 reveals a method of pulsed, full cusp, cross field transport of ions into a solenoid field, with a half cusp beam exit.

Numerous articles have been published detailing the electro-dynamic processes at work when plasmas are transported across generally transverse magnetic fields. To name two: "Propagation of intense plasma and ion beams across B-field in vacuum and magnetized plasma" by Vitaly Bystritskii et. al. published in Laser and Particle Beams (2005), 23, 117-129. Another is "Propagation of neutralized plasma beams" by N. Rostoker et. al. published in Phys. Fluids B 2 (6), June 1990.

BRIEF SUMMARY OF THE INVENTION

An embodiment of the Hall Effect accelerator reveals a neutral gas injection through a gap established in a split solenoid winding pair and a Hall effect vacuum magnetic field gap in a hi-mu return field structure. The neutral gas is ionized and accelerated through the Hall effect vacuum magnetic field established in a gap in a hi-mu axial return flux yoke structure of the solenoid. A magnetic field established transverse to an electric field between an anode and a cathode, resulting in electrons moving in closed drift orbits orthogonal to both the electric and the magnetic fields, is referred to as a Hall effect magnetic field within an acceleration channel. Typically the magnetic field is radial and the electric field is axial, here the magnetic field is axial and the electric field is radial. Electrons are captured in E×B Hall effect orbits (generally referred to as closed drift orbits) in the Hall Effect vacuum magnetic field gap. In the present Hall Effect ion accelerator the Hall Effect field is axial while the gas flow is radial, which is the opposite of the prior art Hall Effect accelerators.

The specific trajectory that an ion will take is determined by the gap magnetic field profile and the gas trajectories as well as where the ion is created from the neutral gas and an acceleration voltage. The gas nozzle determines the gas trajectories. The design of the two pole pieces of the hi-mu yoke determine the magnetic field profile. A additional piece of iron placed on the inner aspect of the solenoid windings, at the gap, will deflect ions into the solenoid. Ion trajectories may be bent azimuthally any chosen degree up until they are reflected out of the field, which occurs when the return magnetic field energy exceeds the ion energy due to the acceleration voltage.

The Hall accelerator realizes a gas nozzle structure that is positioned circumferentially around the gap in the split solenoid. The solenoid return flux yoke conducts the fringe magnetic field from one end of the solenoid to the other. A gap is established in the hi-mu yoke as well as the split solenoid windings. Both are positioned on a common axis of symmetry. The circumferentially positioned collimating nozzle structure is designed such that neutral gas can be directed into the solenoid, generally normal to the axis of symmetry, through the split solenoid gap and the hi-mu yoke gap. A Hall Effect vacuum magnetic field is established in the gap between the two hi-mu flux return yoke structures. Gas directed radially inward from the collimating gas nozzle is associated with an anode and is ionized and then accelerated through the Hall Effect vacuum magnetic field gap. The gas is ionized and accelerated by the electric field established between a cathode and the anode of the Hall Effect accelerator. The anode may be integral with the gas source or separate from the gas source. The cathode electron source may be positioned within the solenoid, or outside the solenoid beyond an exit fringe field. However, the electrons must exclusively enter the Hall Effect vacuum magnetic field gap from within the solenoid.

The gas source may be of any design sufficient to produce a collimated gas flow into the gap in the split solenoid. The nozzle may be any number of individual gas nozzles placed circumferentially around the gap in the split solenoid. The nozzle may direct gas at any chosen azimuthal, tangential or axial angle to the axis and any combination possible.

Intermediate collimating gas throats may be implemented between the gas source and the gap to assist in the collimation of the neutral gas. The intermediate collimating gas throats may be of such design as to control the gas flow trajectories.

Intermediate Hall effect magnetic field sources may be implemented between the anode and the gap to assist in ionization of the neutral gas prior to acceleration through the gap. The intermediate Hall Effect fields may be created by pairs of permanent magnets or by sets of coil windings, or both, producing a generally transverse magnetic field to the gas flow. Where permanent magnets are implemented they would have opposite (attractive) radial fields facing one another. Where electromagnet coils are implemented, they incorporate currents such that the magnetic field is transverse to the gas curtain produced by the collimation nozzles. Typically such magnetic field structures incorporate hi-mu yoke structures. The pole pieces on either side of the hi-mu vacuum magnetic field gap may have any possible geometry to achieve optimal magnetic field variation across the gap. As is well known in the field the pole pieces may also be covered with an electrically insulating layer, or not. The electron density profile as well as the voltage profile across the gap is determined by the return flux pole pieces. The intermediate Hall fields serve to allow Hall Effect electrons to pre-ionize the neutral gas prior to primary acceleration in the split solenoid return magnetic field gap.

Intermediate acceleration electrodes may be implemented between the anode and the Hall Effect vacuum magnetic field gap to assist in acceleration of the ions. The intermediate collimating gas throats may be implemented with intermediate Hall Effect field structures, either electromagnetic or permanent magnets, as well as intermediate acceleration electrodes and associated power supplies, in any possible combination in the vacuum space between the gas source and the split solenoid gap. If the cathode electron source is positioned outside of the solenoid, beyond an open end fringe field(s), the ions will be accelerated a second time as they exit the solenoid and be space charge neutralized by the electrons in all cases. The intermediate electrodes may be associated with the intermediate Hall field magnets or they may be associated with the collimation throats or separate from either or both.

A gas free anode may be accomplished with a pair of anode electrodes. An electrical bias is placed between the anode electrodes implemented on opposite sides of the gas flow. The anode electrodes are linked by Hall Effect magnetic field lines which allow electrons to flow onto the more positive of the anode electrodes. The gas free anode completes the acceleration circuit keeping the electrons from reaching the gas source. The gas free anode may be the split solenoid Hall Effect vacuum magnetic field gap field or an intermediate Hall Effect magnetic field. This novel composition of elements makes possible the separation of the anode and the neutral gas source structure. Thereby protecting the gas source structure from bombardment by the counter-streaming Hall Effect electrons. This feature is referred to herein as a gas free anode, because the gas source is separate from the anode.

In a continuous circumferential Laval nozzle the gas will have a broad dispersion across the plane of the nozzle. To produce the desired radial or tangential gas trajectories, dividing elements which form multiple channels are introduced into the gas nozzle structure. The channels, whether composed of tubes, plates, baffles or other methods for channeling the gas flow, serve to control the dispersion of the gas trajectories. The design of the channels is complicated by the preference for a convergent-divergent Laval type of supersonic focusing nozzle. The nozzle structure may produce gas trajectories that are normal to the axis of the solenoid, or at any angle relative to the axis of symmetry. The nozzle angles may be axial, azimuthal and or radial, and any geometric combination thereof. The gas nozzles, may be point sources, arc sections, or complete and continuous annuli and any combination thereof. The canonical angular momentum of the orbits that the ionized gas particles produce within the solenoid are partially determined by the initial gas trajectories as determined by the nozzle construction elements.

Because the collimated gas particles are limited in their trajectories to only the channel of acceleration, the intermediate Hall field elements and the acceleration electrodes as well as the gas free anode elements may be suspended in the free space within the vacuum vessel. In prior art Hall Effect accelerators a coaxial channel is required to direct the gas, which is not collimated and therefore is traveling generally without specific direction.

Characteristics of the ion orbits within the solenoid are related to the following system parameters:

The neutral gas trajectories.

The coordinates of ionization.

The radial dimension of the solenoid.

The acceleration voltage.

The solenoid magnetic field strength.

The cathode electron source characteristics.

The presence of intermediate electrodes.

The presence of intermediate magnetic fields.
The geometric design of the return flux yoke pole pieces.
Gas scattering on background gas, ions, electrons etc.

DETAILED DESCRIPTION OF THE INVENTION

Figure 1:
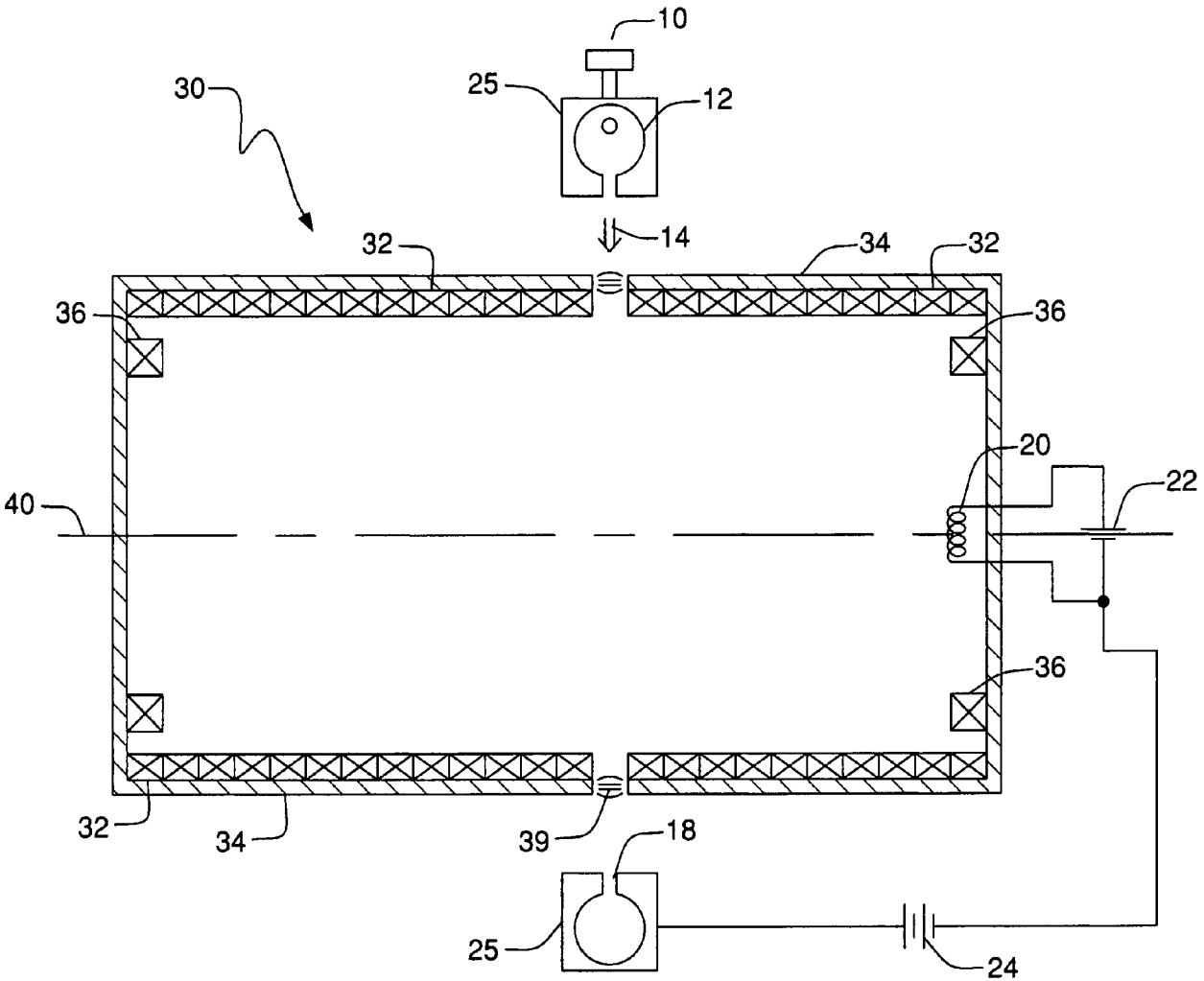
FIG. 1 is a side perspective cross sectional view of an embodiment of the invention where the gas source is also the anode and the electron source is internal to the solenoid.

FIG. 1 reveals an embodiment of the present invention. A split solenoid 30 with an axis 40 establishes a solenoid magnetic field by coil windings 32. Mirror coils 36 at each end serve to establish a magnetic bottle. The split solenoid return magnetic field is conducted by a return flux yoke 34. A Hall Effect vacuum magnetic field gap 39 is formed between two sections of return flux yoke 34. Gas 10 is introduced into a plenum 12. The gas 10 is collimated by nozzle 18, thereby forming a radially inward moving, circumferential gas sheath 14. The gas sheath 14 travels through a vacuum into the Hall Effect vacuum magnetic field gap 39. Gas sheath 14 is ionized by electrons that transit through the Hall Effect vacuum magnetic field gap 39 from cathode electron source 20 and associated power supply 22. A power supply 24 provides beam acceleration voltage potential between an anode gas source 25 and cathode electron source 20. Ions are accelerated into the solenoid by the acceleration power supply 24 between the anode gas source 25 and the cathode electron source 20 through the Hall Effect vacuum magnetic field gap 39. Within the Hall Effect vacuum magnetic field gap 39, acceleration and bending of the ions' trajectories causes the ions to form energetic orbits within the solenoid.

Figure 2:
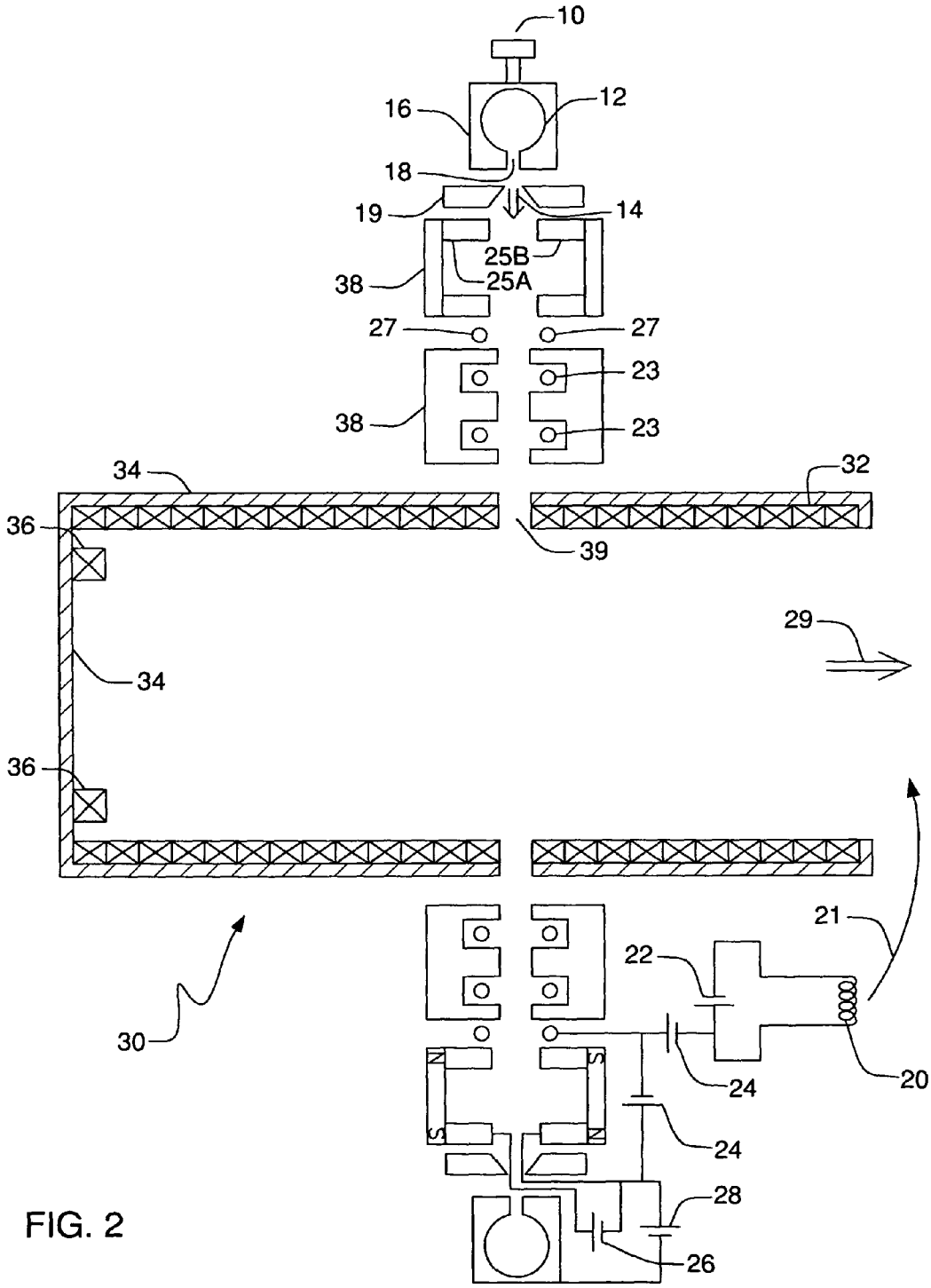
FIG. 2 is a side perspective cross sectional view of a second embodiment of the invention having a gas free anode isolated from the gas source, a collimating throat, intermediate Hall Effect magnetic field structures, intermediate electrodes and the electron source is external to the solenoid.

Another embodiment of the present invention is disclosed in FIG. 2. Gas 10 is introduced into plenum 12. The gas 10 is collimated by nozzle 18, and further collimated by collimating gas throat 19, thereby forming a radially inward moving, circumferential gas sheath 14. An electron gathering gas free anode structure is comprised of a bias supply 26 and a pair of anode electrodes 25A and 25B which are linked by a Hall effect magnetic field source 38. The bias supply 26 provides an electric potential between the two electrodes 25A and 25B which draws the electrons to the more positive of the two anode electrodes 25A and 25B. The gas free anode isolates the gas nozzle 18 from electron 21 bombardment. A reverse bias battery 28 further prohibits electrons from encountering the gas nozzle 18. Intermediate magnetic field sources 38 may be constructed of permanent magnets or electromagnet windings 23. Intermediate electrodes 27 may also be implemented to control the ions. In this embodiment the cathode electron source 20 and 22 are positioned external to the solenoid. Electrons 21 from the external cathode electron source 22 must enter the solenoid through the end fringe field. Ions 29 are accelerated into the solenoid 30 through the split solenoid vacuum magnetic field gap 39 and then out of the solenoid 30 through the open end fringe field. In both cases electrons 21 are streaming in the opposite direction from the ions 29 as is characteristic of Hall accelerators.

Figure 3A:
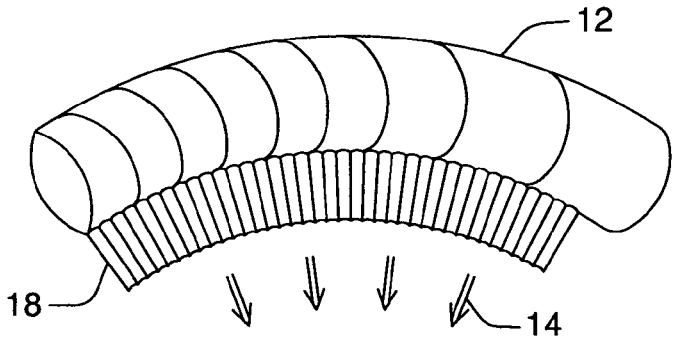
FIG. 3A is a cross sectional view of a radial gas nozzle.
Figure 3B:
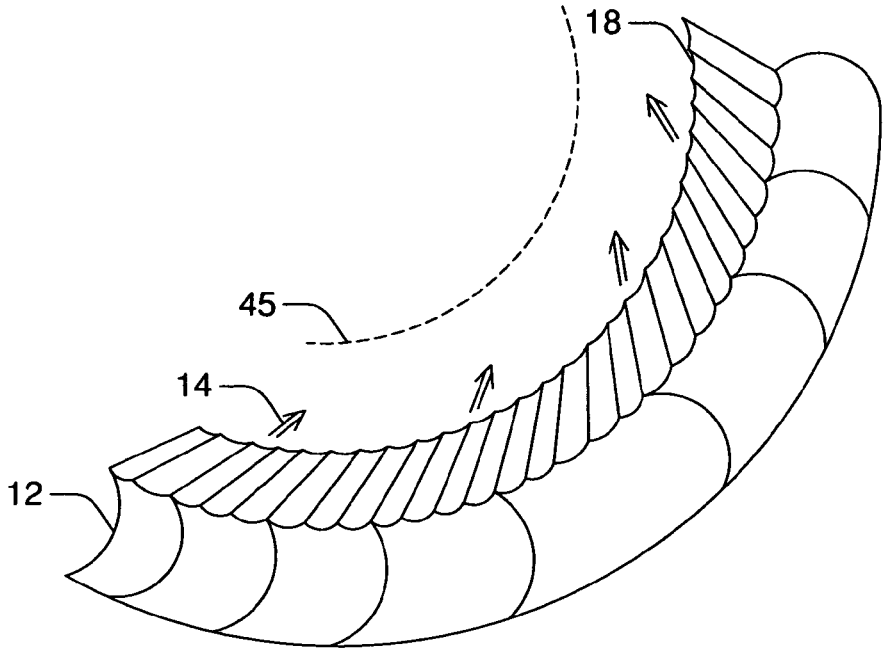
FIG. 3B is a cross sectional view of a tangential gas nozzle.

FIG. 3A details a gas nozzle for controlling the initial neutral gas trajectories such that they have the desired radial trajectory. FIG. 3B details a gas nozzle for controlling the initial neutral gas trajectories such that they have the desired tangential trajectories. The circumferential gas nozzles are comprised of one or more individual gas nozzles disposed circumferentially around the vacuum gap formed in the split solenoid. Gas introduced into plenum 12 exits through nozzles 18 forming well defined gas trajectories 14. FIG. 3A produces gas trajectories convergent to the axis. FIG. 3B produces gas trajectories tangent to the axis of symmetry of the solenoid field, at some chosen radius 45.

Figure 4A:
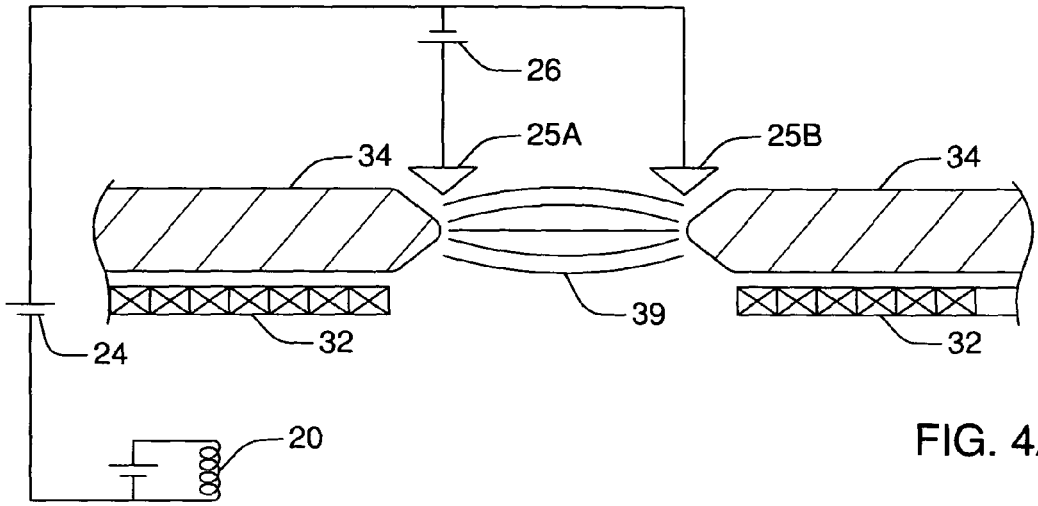
FIG. 4A shows details of a Hall Effect vacuum magnetic field gap return flux yoke configuration and gas free anode electrodes.
Figure 4B:
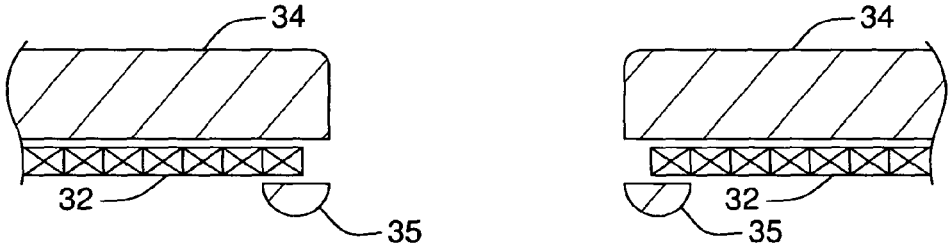
FIG. 4B shows an alternate embodiment of the Hall Effect vacuum magnetic field gap return flux yoke configuration.

FIG. 4A details gas free anode electrodes 25A and 25B in the magnetic field gap 39. FIG. 4B details a vacuum gap that contains hi mu elements 35 on the inner aspect of the split solenoid windings 32 proximal to gap 39. Hi mu elements 35 on the inner aspect of solenoid windings 32 assist in kicking the ions into the solenoid 30.

Thus there has been described a novel closed drift Hall type accelerator. It is important to note that many configurations can be constructed from the ideas presented. The foregoing disclosure and description of the invention is illustrative and explanatory thereof and thus, nothing in the specification should be imported to limit the scope of the claims. Also, the scope of the invention is not intended to be limited to those embodiments described and includes equivalents thereto. It would be recognized by one skilled in the art the following claims would encompass a number of embodiments of the invention disclosed and claimed herein.

I claim:

1. An ion accelerator comprising:

a split solenoid magnetic field structure having a high mu return field yoke and an axis of symmetry;

a hall effect vacuum magnetic field gap established between two halves of the high mu return field yoke of the split solenoid magnetic field structure;

a gas source positioned external to the solenoid;

the gas source capable of delivering gas into the solenoid through the hall effect vacuum magnetic field gap;

an anode positioned external to the solenoid proximal to the hall effect vacuum magnetic field gap;

a cathode capable of producing electrons that enter the hall effect vacuum magnetic field gap from within the solenoid;

an electric circuit capable of establishing an electrical potential field between the anode and the cathode;

the electric potential field established between the cathode and the cathode electrons and the anode causing the gas from the gas source to become ionized; and the ions being accelerated by the electric field between the anode and the cathode into the solenoid through the hall effect vacuum magnetic field gap.

2. The ion accelerator of claim 1 wherein the solenoid return flux field is conducted by the two halves of the high mu return field yoke of the split solenoid magnetic field structure having pole pieces covered with electrically insulating material.

3. The ion accelerator of claim 1 wherein the solenoid return flux field pole pieces optimize the magnetic field profile across the hall effect vacuum magnetic field gap.

4. The ion accelerator of claim 1 wherein the gas source is comprised of a collimating gas nozzle.

5. The ion accelerator of claim 1 wherein the gas source is also anode.

6. The ion accelerator of claim 1 wherein the gas source is separate from the anode.

7. The ion accelerator of claim 6 wherein an anode element is comprised of a pair of electrodes, an electrical bias field applied between said electrodes, said electrodes connected by magnetic field lines allowing the bias field to direct hall effect electrons onto the anode element essentially distinct and separate from the gas source.

8. The ion accelerator of claim 7 further comprising at least one intermediate magnetic field structure located between the anode and the solenoid.

9. The ion accelerator of claim 1 wherein the gas source is comprised of a circumferential collimating gas nozzle.

10. The ion accelerator of claim 1 wherein the collimating gas source is at an angle relative to the axis of symmetry.

11. The ion accelerator of claim 1 wherein the gas source is comprised of a plurality of individual collimating gas point sources.

12. The ion accelerator of claim 1 wherein the gas source is comprised of a plurality of individual collimating gas arc sections.

13. The ion accelerator of claim 1 wherein the collimating gas nozzle provides a means for producing gas trajectories at specific angles tangent to a given radii from the axis of the magnetic field.

14. The ion accelerator of claim 1 further comprising at least one collimating throat disposed between the gas source and the solenoid.

15. The ion accelerator of claim 1 further comprising at least one intermediate electrode disposed between the anode and the solenoid.

16. The ion accelerator of claim 1 further comprising at least one intermediate magnetic field structure disposed between the anode and the solenoid.

17. The ion accelerator of claim 1 further comprising at least one intermediate magnetic field structure located between the anode and the solenoid.

18. An ion beam accelerator comprising:

means for producing a gas flow into a Hall Effect vacuum magnetic field gap established in a return flux field of a split solenoid magnetic field; and means for ionizing and accelerating the gas flow through the vacuum gap into the solenoid field.

19. A method for producing an ion beam, the method comprising the steps of:

providing a gas flow into a hall effect vacuum magnetic field gap in a split solenoid;

ionizing said gas flow;

placing an anode external to the solenoid operating in conjunction with a cathode;

accelerating the ionized gas into the solenoid magnetic field; and producing a neutralized ion beam of high current within the solenoid field.

20. An ion beam accelerator comprising:

means for providing a gas flow into a hall effect vacuum magnetic field gap in a split solenoid;

means for providing a cathode electron source external to a solenoid magnetic field, beyond the end fringe field;

means for ionizing and accelerating the gas flow through the vacuum gap;

means for accelerating the ions a second time to exit the solenoid through the end fringe field towards the cathode electron source.

21. An ion accelerator comprising:

a nozzle structure for receiving a gas and forming the gas into a collimated gas stream;

an anode;

a virtual cathode composed of closed drift hall electrons;

the anode and virtual cathode operable such that the gas stream is ionized;

a magnetic field structure having a split solenoid and a return flux hall effect vacuum magnetic field gap;

an ionized gas sheath entering the return flux magnetic gap and the ions being accelerated into the magnetic field structure; and the ions being space charge neutralized by the electrons present throughout the accelerator.

* * * * *